United States Patent [19]

Steingroever et al.

[11] 4,384,313

[45] May 17, 1983

[54] PROCESS FOR DEMAGNETIZING COMPONENTS BY ALTERNATING MAGNETIC FIELDS OF VARYING INTENSITY

[76] Inventors: Erich Steingroever, Flensburger Strasse 33, 53 Bonn; Dietrich Steingroever, Bergisch, Gladbach, both of Fed. Rep. of Germany

[21] Appl. No.: 233,773

[22] Filed: Feb. 12, 1981

[30] Foreign Application Priority Data

Feb. 16, 1980 [DE] Fed. Rep. of Germany ..... 3005927

[51] Int. Cl.[3] ..... H01F 13/00

[52] U.S. Cl. ..... 361/149; 361/267

[58] Field of Search ..... 361/149, 267, 147, 148

[56] References Cited

U.S. PATENT DOCUMENTS 2,445,459 7/1948 Snyder ..... 361/149 X 3,638,074 1/1972 Inouye ..... 361/149 X 3,895,270 7/1975 Maddox ..... 361/149

FOREIGN PATENT DOCUMENTS 1481190 7/1977 United Kingdom ..... 361/149

*Primary Examiner*—Reinhard J. Eisenzopf

*Attorney, Agent, or Firm*—Fisher, Christen & Sabol

[57] ABSTRACT

A process for demagnetizing components by subjecting them to the influences of the alternating magnetic field of a coil supplied by an oscillator circuit which includes a capacitor also includes providing a voltage supply to the oscillator at the resonant frequency and thereafter reducing the intensity of the alternating field acting on the components. This can be done in several ways, such as by varying the frequency of the supply voltage or by varying the capacitance connected in circuit with the coil. The process may also be used for calibrating permanent magnets.

26 Claims, 8 Drawing Figures

PROCESS FOR DEMAGNETIZING COMPONENTS BY ALTERNATING MAGNETIC FIELDS OF VARYING INTENSITY

BACKGROUND OF THE INVENTION

The invention concerns a process for the demagnetization or for the magnetic calibration of parts of ferromagnetic materials, in particular for the demagnetization or calibration of permanent magnets, as well as for the demagnetization of components that have been exposed to a magnetic field during processing and have retained a residual magnetism from it, for example parts that have been ground on magnetic clamping plates, or chucks, or parts that are to be totally free of residual magnetism, such as ball bearings.

A known demagnetizing process consists of exposing such parts to an alternating magnetic field of decreasing intensity, for example to conduct them through the field of an AC-powered coil or to expose them within a coil to the decreasing alternating field of a periodic capacitor discharge.

These known processes cause severe heating of the field coil when in continuous operation. The capacitor-discharge process is not continuous one and hence is difficult to automate.

Both processes suffer from the fact that for the production of a high demagnetizing field intensity in a coil, the latter absorbs a high reactive current. If this is compensated in the known manner by means of a series- or parallel-connected capacitor, then the resonant frequency at which the current maximum appears is dependent on the quantity and type of parts inserted into the coil. In addition, the intended compensation is made more difficult by the variation of the capacitance of the connected capacitor resulting from warming during operation and by its variation in time. The invention avoids these deficiencies.

SUMMARY OF THE INVENTION

This invention concerns a process for the demagnetization of components that are exposed to the alternating magnetic field of a coil that forms an electrical oscillator circuit with a capacitor. It is characterized by the fact that (a) the frequency of the supply voltage is brought to the resonant frequency of the oscillator circuit, and
(b) thereafter the intensity of the alternating field acting on the parts is reduced.

In one embodiment of the process in accordance with the invention, a control voltage is produced from the phase shift between the current and voltage of the oscillator circuit, which control voltage brings the supply voltage to the resonant frequency.

In another configuration of the invention the frequency of the supply voltage is continuously varied from a value below the resonant frequency to above the resonant frequency and back again to below it. Here there is certainty that the actual resonant frequency is passed through even when it varies or has been changed under the circumstances cited above. The advantage of this process lies in the fact that on an average there is less heating of the coil because the high current at the resonant frequency appears only briefly, and nevertheless demagnetization is guaranteed by the high resonant current.

This demagnetization process in accordance with the invention can be carried out in such a way that the frequency of the demagnetizing current is modulated by a varying low frequency so that the resonant frequency of the oscillator circuit is definitely passed through from a frequency on one side of the resonant to a frequency on the other side. In the case of a 50 Hz. power supply, in accordance with the quantity and type of components introduced into the alternating field and the condition of the capacitor the resonant frequency may lie somewhere between 45 and 55 Hz, for example. Thus, the frequency of the demagnetizing current can be varied between 40 and 60 Hz. by modulating it with fairly low frequencies, for example, between 0.1 to 10 Hz., and preferably between 0.3 and 3 Hz. In the case of a 60 Hz. power supply, it would be desirable to vary the frequency of the demagnetizing current between 50 and 70 Hz.

The process of this invention is also useful for the purpose of calibrating permanent magnets to a particular working point by immediately lowering the intensity of the alternating field when a value associated therewith, has been reached, for example, the magnetic flux density in the air gap.

DESCRIPTION OF PREFERRED EMBODIMENTS OF THE INVENTION

Figure 1:
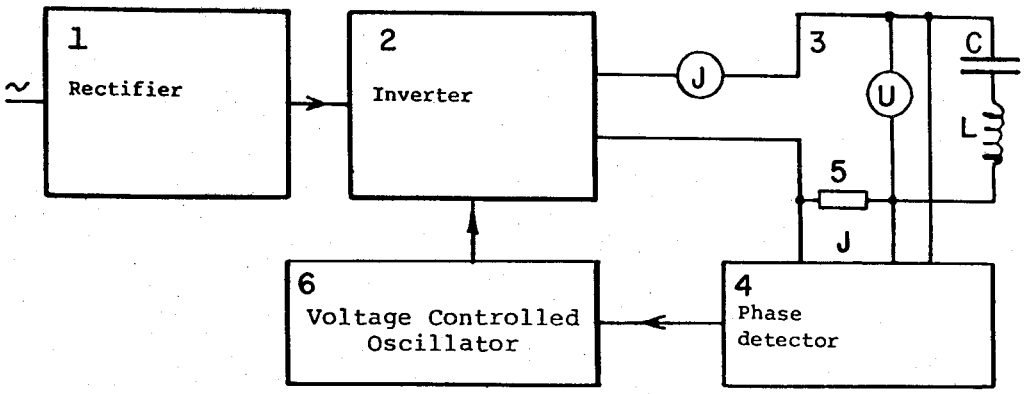
FIG. 1 is a block diagram of a circuit for reducing the intensity of the alternating field during demagnetization.

A preferred form of circuit for producing a decreasing amplitude in the demagnetizing field is shown in FIG. 1. There, 1 is a rectifier, 2 a frequency-controlled inverter that supplies the voltage for the oscillator circuit 3 comprising the demagnetization coil L and the capacitor C. The phase shift between the voltage and the current of the oscillator is determined by means of the phase detector 4 that is connected to the oscillator circuit and a small in-series resistance 5, which drops a voltage proportional to the current I. The number 6 designates an oscillator controlled by the output voltage of the phase detector, which oscillator pulses the inverter 2 at such a frequency that the phase angle between the current and voltage of the oscillator circuit is zero and thus in each case automatically adjusts the resonant frequency and produces the decreasing amplitude of the alternating field acting on the parts to be demagnetized in the known manner by withdrawal of the same from the coil.

Figure 2:
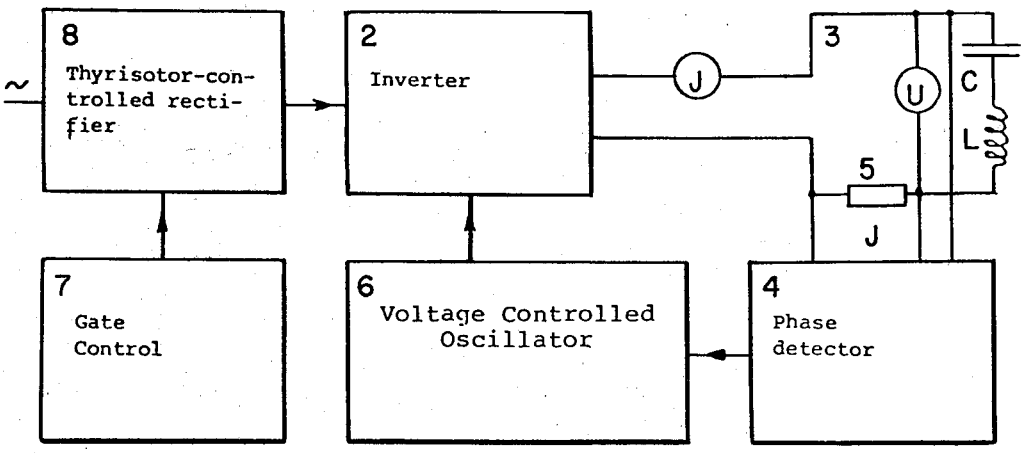
FIG. 2 is a block diagram of a circuit in which the reduction is accomplished by lowering the voltage.

The decreasing intensity of the alternating field can also be produced by reduction of the voltage supplied by the rectifier. The circuit diagram is represented in FIG. 2. There a gate control 7 for the thyristor-switched rectifier 8 produces the desired reduction in its voltage after the resonant frequency is reached. The other designations in FIG. 2 have the same significance as in FIG. 1.

As indicated above, the intensity of the demagnetizing field can also be varied by varying the frequency of the demagnetizing field from a value from below its actual resonant frequency to a value above the resonant frequency. Ordinarily, it will be sufficient; if the actual resonant frequency is not readily available, to shift the demagnetizing frequency from a value about 10 Hz. below the power supply frequency to a value about 10 Hz. above the supply frequency.

Figure 3:
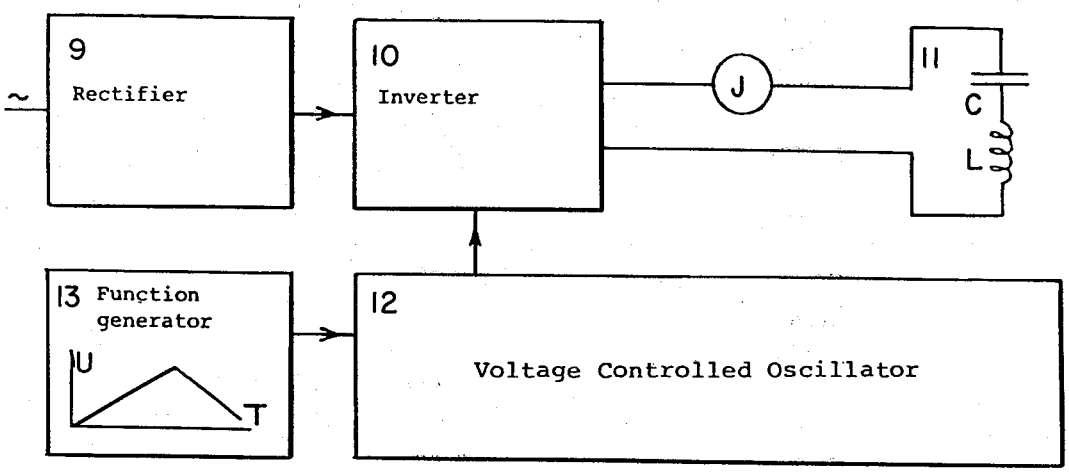
FIG. 3 is a block diagram of a circuit for varying the frequency of the demagnetizing field.

This embodiment of the invention is shown in FIG. 3, in which 9 is a rectifier and 10 is an inverter that supplies the A.C. current for the oscillator circuit 11, which includes a demagnetizing coil L. The number 12 designates a voltage controlled oscillator that pulses the inverter 10. Its frequency is determined by a function generator 13 that supplies a voltage continuously rising and falling at low frequency. By virtue of this the frequency of the oscillator increases to above the resonant frequency of the oscillator circuit and then decreases to a lower value. Correspondingly, the intensity of the alternating field in the coil L rises and reaches a maximum at the resonant frequency and then decreases again after exceeding it and again passes through the maximum with the decrease in the frequency. In this embodiment of the invention the demagnetization of the parts takes place even while they are still disposed within the coil.

In accordance with the invention it is also advantageous to drop the frequency of the demagnetizing alternating field from a value above the resonant frequency down to or below it and then to raise the frequency again. In this way a decrease in the intensity is achieved in a particularly effective manner with the rising frequency after the resonant frequency is exceeded.

Figure 4:
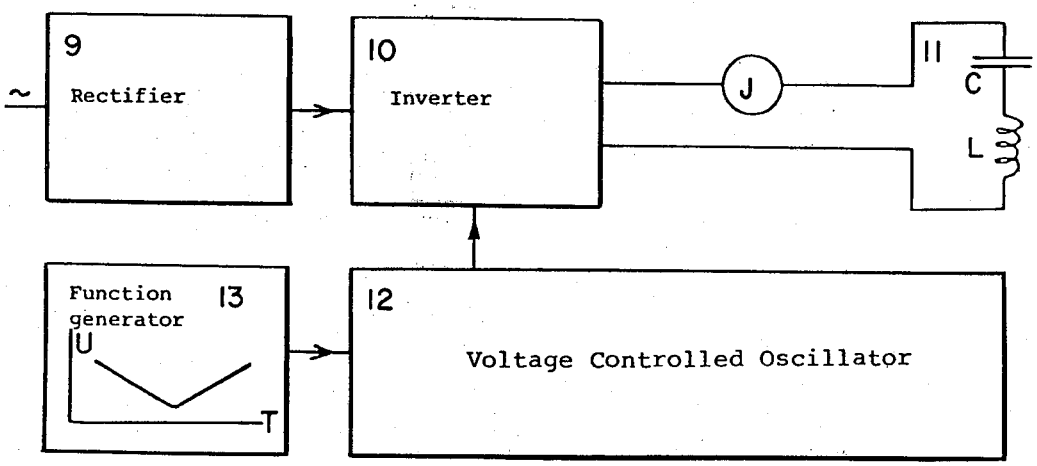
FIG. 4 is a block diagram of a circuit for reducing the frequency of the demagnetizing field from a value above resonant frequency and thereafter increasing from below the resonant frequency.

A block diagram for such a circuit is shown in FIG. 4, and it will be seen that it is substantially identical to the arrangement shown in FIG. 3 except for the fact that the function generator is programmed to operate the oscillator 11 and the demagnetizing coil L initially at a frequency higher than the natural resonant frequency of the system, thereafter reducing the frequency at a continuous rate to such an extent that is passes through the resonant frequency to a lower than resonant frequency, at which point the process is reversed and the frequency is continuously increased until it returns to a value approximately the same as that of the oscillator at the beginning.

The process in accordance with the invention can also be used for the calibration of permanent magnets to a particular working point by measuring a value associated therewith, e.g. the magnetic flux density in its airgap, during demagnetization and by then again lowering the intensity of the alternating field immediately upon reaching the adjustable desired value.

Figure 5:
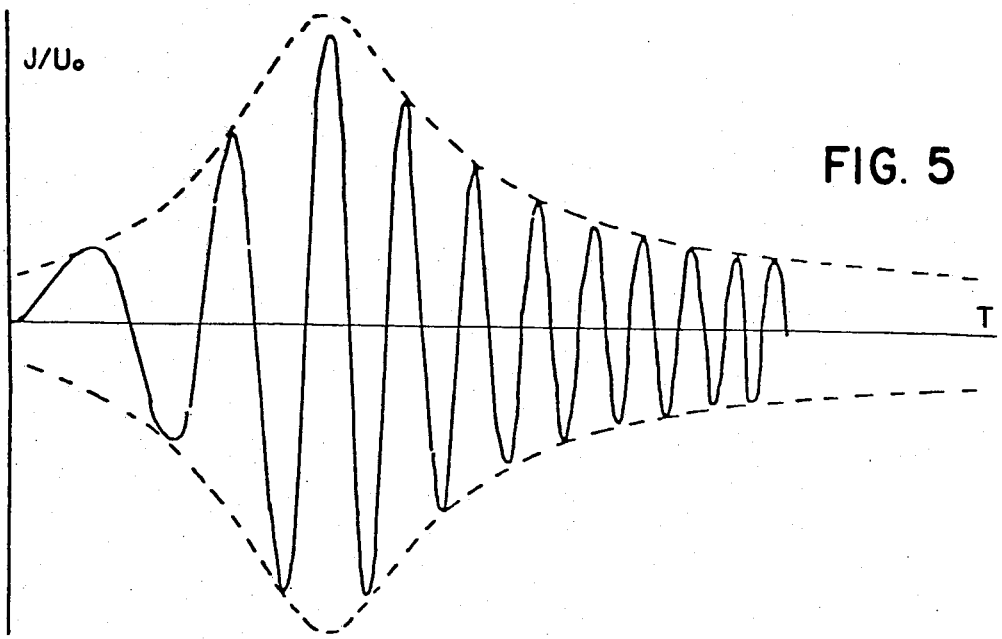
FIGS. 5 and 6 represent the values of inductance of a field coil plotted against time with, and without, the introduction of parts to be demagnetized, respectively.
Figure 6:
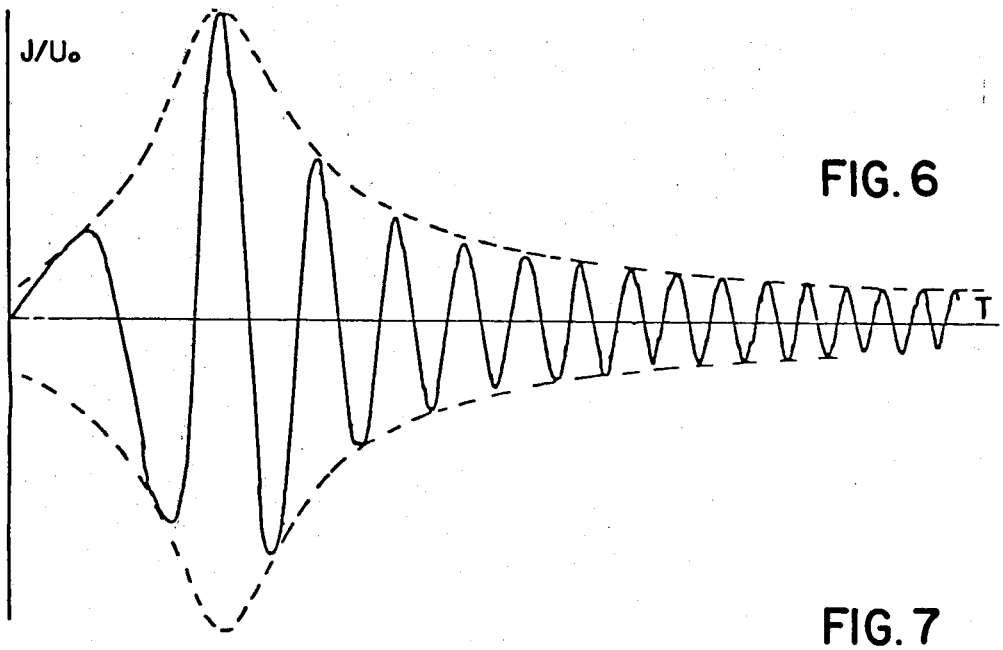

For the case of rising frequency of the demagnetization current I/Uo in accordance with the invention, a possible plot of the current curves for two different values of the inductance L of the filed coil (with and without introduced parts to be demagnetized, respectively) is plotted as a function of time T in FIGS. 5 and 6. The envelopes of the current maxima are also plotted in broken lines in these Figures.

Figure 7:
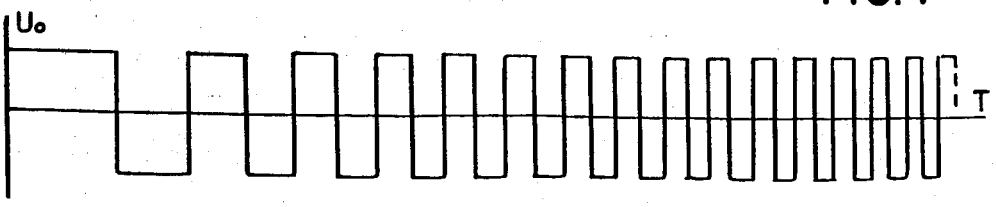
FIG. 7 illlustrates the increasing frequency of trigger pulses used to obtain the values illustrated in FIGS. 5 and 6.

In both cases the possible current maxima are automatically reached or passed through at resonance. Below these current curves, FIG. 7 indicates the trigger voltage supplied to the inverter 10, the frequency of which increases with time. In these representations, for graphic reasons, the ratio between the current frequency and the modulation frequency is selected as 10:1, in actuality it can be higher, for example 30:1 to 100:1.

Figure 8:
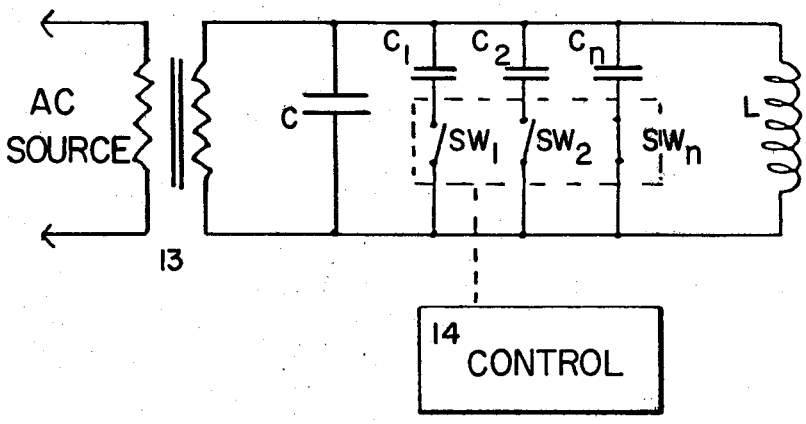
FIG. 8 is a block diagram for obtaining a step by step variation in demagnetization frequency.

In another embodiment of the invention, the resonant frequency of an oscillator circuit containing the inductance L producing the demagnetizing field is varied stepwise by connection and disconnection of one or more trimmer capacitors, in which case, again in accordance with the invention, the particular resonant frequency is reached or passed through. Such an arrangement is represented in FIG. 8, in which a transformer 13 is connected to an AC power source (not shown) to supply an oscillator circuit comprising the demagnetizing coil L, a main capacitor C and a series of parallel-connected trimmer capacitors $C_1$, $C_2$ and $C_n$ which can be switched into, and out of, the circuit by means of Switches $SW_1$, $SW_2$. . . $SW_n$ which may comprise electromechanical relays or electronic switches (triacs) that are sequentially actuated by a time-dependent control 14. The magnitude of the capacitors $C_1$, $C_2$, . . . , $C_n$ values of the resonant frequency are produced. For example, it is advantageous to vary the resonant frequency in steps of 5% of the expected resonant frequency, which is the case with connection and disconnection of capacitors with capacitances of approximately 10% of the principal capacitance C.

In all embodiments of the invention in accordance with the invention the oscillator circuit can be configured with parallel or series LC circuits although, for simplicity, only a parallel arrangement is shown in FIG. 8.

What is claimed is:

1. In a process for the demagnetization of components subjected to the influence of an alternating magnetic field of a coil connected with capacitor means in an oscillator circuit supplied by an alternating voltage means, comprising the steps of:

(a) placing a component to be demagnetized in the vicinity of said coil to be subjected to an alternating magnetic field generated by said coil;

(b) varying the phase between voltage and current of the oscillator circuit to produce a control voltage to bring the frequency of the supplied voltage from a non-resonant frequency to the resonant frequency of the oscillator circuit, and;

(c) thereafter reducing the intensity of the alternating magnetic field to which said component is subjected.

2. The process of claim 1, wherein the frequency of the supplied voltage is varied from a value below the resonant frequency to a value above the resonant frequency.

3. The process of claim 2, wherein the frequency of the supplied voltage is reduced from said frequency value above the resonant frequency value to a value below the value of the resonant frequency.

4. The process of any one of claims 1, 2 or 3, which includes the step of conducting the component to be demagnetized continuously through the magnetic field of said coil.

5. The process of any one of claims 1, 2 or 3, wherein said component is a permanent magnet.

6. The process of any one of claims 1, 2 or 3, wherein said component is a residually magnetized element resulting from incidental exposure to a magnetic field.

7. The process of any one of claims 1, 2 or 3, wherein said component is a permanent magnet, and said demagnetization is carried out only to a selectively predetermined value.

8. The process of either one of claims 2 or 3, wherein the current is supplied to the oscillator at the frequency of the commercially avilable power supply, and said supplied current is modulated by a current having a lower frequency.

9. The process of claim 8, wherein said component is a permanent magnet.

10. The process of claim 8, wherein the frequency of said modulating current is within the range of between 0.1 and 10.0 Hz.

11. The process of claim 10, wherein said component is a permanent magnet.

12. The process of claim 10, wherein said component is a residually magnetized element resulting from incidental exposure to a magnetic field.

13. The process of claim 10, wherein said component is a permanent magnet, and said demagnetization is carried out only to a selectively predetermined value.

14. The process of claim 8, wherein the frequency of said modulating current is within the range of between 0.3 and 3.0 Hz.

15. The process of claim 14, wherein said component is a permanent magnet.

16. The process of claim 14, wherein said component is a residually magnetized element resulting from incidental exposure to a magnetic field.

17. The process of claim 14, wherein said component is a permanent magnet, and said demagnetization is carried out only to a selectively predetermined value.

18. The process of claim 8, wherein said component is a residually magnetized element resulting from incidental exposure to a magnetic field.

19. The process of claim 8, wherein said component is a permanent magnet, and said demagnetization is carried out only to a selectively predetermined value.

20. The process of claim 1, which includes the step of reducing the intensity of the alternating magnetic field by reducing the supplied voltage.

21. The process of claim 20, wherein said component is a permanent magnet.

22. The process of claim 20, wherein said component is a residually magnetized element resulting from incidental exposure to a magnetic field.

23. The process of claim 20, wherein said component is a permanent magnet, and said demagnetization is carried out only to a selectively predetermined value.

24. The process of claim 1, which includes the step of withdrawing the component to be demagnetized from the vicinity of said coil.

25. The process of claim 1, wherein said oscillator comprises an LC circuit means, which includes the step of changing the resonant frequency by the addition, or substraction, of a trimmer capacitor.

26. The process of claim 25, wherein said addition, or substraction of the trimmer capacitor is controlled by control means responsive to time.

* * * * *